United States Patent [19]

Landrus

[11] 4,380,312

[45] Apr. 19, 1983

[54] STAPLING TOOL

[75] Inventor: Edward L. Landrus, Coon Rapids, Minn.

[73] Assignee: Minnesota Mining and Manufacturing Company, St. Paul, Minn.

[21] Appl. No.: 169,796

[22] Filed: Jul. 17, 1980

[51] Int. Cl.[3] ..... B25C 1/04; B25C 1/06; B25C 3/00

[52] U.S. Cl. ..... 227/116; 227/131

[58] Field of Search ..... 227/130, 147, 114, 116, 227/119, 131, 139

[56] References Cited

U.S. PATENT DOCUMENTS

| | | | |
|---|---|---|---|
| 2,918,675 | 8/1958 | Smith . | |
| 3,017,636 | 1/1962 | Koennecke . | |
| 3,612,378 | 10/1971 | Pabich et al. | 227/130 X |
| 3,727,827 | 4/1973 | Pabich | 227/130 X |
| 3,834,602 | 9/1974 | Obergfell . | |
| 3,858,782 | 1/1975 | Pomeroy . | |
| 4,054,237 | 10/1977 | Riefueld | 227/147 |
| 4,087,035 | 5/1978 | Harmon . | |

*Primary Examiner*—Paul A. Bell

*Attorney, Agent, or Firm*—Cruzan Alexander; Donald M. Sell; William D. Bauer

[57] ABSTRACT

A tool for applying fasteners to fasten an article to the workpiece. A compressible foot is provided to limit the drive distance of a plunger to position dependent upon the thickness of the article. A drive groove in the tool provides support for the fastener until it is driven into the workpiece. The fastener may be a plastic staple and multiple driving strokes may be used to drive the staple into the workpiece. A retainer activated by the compressible foot may be utilized to prevent the advancement of the next staple to the drive position while multiple drive strokes are being used.

19 Claims, 8 Drawing Figures

STAPLING TOOL

BACKGROUND OF THE INVENTION

The present invention relates generally to tools for applying fasteners to a workpiece and more particularly to such tools where guiding of the fastener to the workpiece is required, where a controlled depth of drive is advantageous and where multiple impacts may be advantageous.

Many types of tools exist in the prior art which can be used to fasten articles to a workpiece using suitable fasteners. There are, of course, many articles which can be commonly desired to be fastened to the workpiece. One of those articles is electrical cable. One particular type of electrical cable which is commonly stapled to the wooden frame construction of a dwelling or other building is Type NM cable, also known as Romex. Type NM cable is extensively used in the wood frame building construction.

Several types of fasteners have been used to fasten such an electrical cable to the wood frame construction. One of these fasteners is a staple consisting of a plastic strap with a nail punched through the plastic strap on either side of the cable. Another is a metal staple formed with a substantially U-shape. Both of these common staples suffer from the same disadvantages. Both are loose piece fasteners. That is, the staples are individual and must be individually selected and utilized. Another disadvantage for these common staples is that they require multiple of blows from a hammer. This requires essentially a manual operation hammering the staples in place around the electrical cable.

There do exist some staplers suitable for this use; however, these staplers usually suffer from the problem of being very large and cumbersome due to the power required to drive a staple with one blow. And they suffer the further disadvantage in that the material utilized for the staples is limited due to the force required to drive the staple with a single blow. The staple must be strong enough to survive the impact causing it to be driven with one blow. A further disadvantage is encountered in that with vinyl sheathed electrical cable it is desirable to control the drive depth of the stapler. The staple must be driven far enough to allow it to securely hold the electrical cable but must not be driven too far causing a cutting of the vinyl sheath or electrical insulation of the wires. With a stapling tool, this is a particular problem since these tools are generally large and cumbersome and it is difficult to see how far the staple is being driven. This is also a problem with multiple impact staplers since the number of impacts required depends upon the thickness of the article or articles being fastened, the particular staple being used, the resistance of the workpiece to the staple and the possible deflection of the workpiece away from the tool.

SUMMARY OF THE INVENTION

The present invention relates to a tool for applying fasteners to fasten an article to a workpiece. A fixed guide is utilized for holding a plurality of the fasteners with one of the fasteners being held in a drive position. A compressible foot is adapted to contact the workpiece and be compressed into the fixed guide a distance dependent upon the thickness of the article being fastened. When the compressible foot is compressed, the fastener located in the drive position is engaged in a drive groove defined by the compressible foot. This drive groove provides support for that staple during the entire driving operation. A plunger then drives the fastener located in the drive position through the drive groove of the compressible foot and into the workpiece. A drive limiter is coupled to the plunger to prevent the plunger from driving beyond a predetermined position relative to the fixed guide. In this manner, the fastener located in the drive position may be driven into the workpiece a distance dependent upon the thickness of the article.

The tool may also contain a retainer coupled to the fixed guide and activated by the compression of the compressible foot for preventing the advancement of the fastener being held in a retaining position next to the drive position. When the retainer is activated by the compressible foot being compressed, the next staple to be driven is prevented from advancing to the drive position so that the plunger may make multiple drive impacts or strikes to the fastener located in the drive position. The retainer may be a groove in the compressible foot located adjacent to the drive groove.

The compressible foot may also be adapted to position the article on the workpiece during the fastening operation. The tool may also further have a fastener holder for supplying additional staples to the fixed guide. A wide variety of power means may be supplied to the plunger. Two of the most common perhaps would be an electric powered solenoid and cocked spring, which may be cocked, for example, by action of a rotary electric motor.

This tool then guides the fastener being utilized and provides support to the fastener while it is being driven into the workpiece and limits the depth of drive to the fastener to prevent overdriving of the fasterner. The tool also allows for multiple impacts of the plunger to the staple so that a smaller impact of force may be utilized. This is especially important where a relatively fragile fastener is utilized, for example, a staple constructed from a plastic material and where the size and weight of the tool is important.

Another feature of the present invention is that when the compressible foot is compressed, a force is being applied by the compressible foot to the workpiece. This force tends to preload the workpiece and tends to diminish the deflection of the workpiece away from the stapler as the staple is being driven. Further, since there is already force by the tool against the workpiece the tool will tend to follow the workpiece if it should move relative to the tool. Further, if the workpiece does move relative to the tool, that is deflect away from the tool, the compressible foot can retract somewhat to remain in contact with the workpiece and to provide a guidance for the fastener during the entire driving operation and hold the tool in position for further impacts.

BRIEF DESCRIPTION OF THE DRAWINGS

The foregoing advantages, construction and operation of the present invention will become more readily apparent from the following description and accompanying drawings in which.

DESCRIPTION OF THE PREFERRED EMBODIMENTS

A preferred embodiment of the tool of the present invention is constructed to enable the use of plastic staples to be utilized to fasten Type NM electrical cable to the wood framing of a wood frame construction building. Such a suitable plastic staple may be formed with essentially parallel vertical side members each having a conical point to assist driving into the workpiece, and having a top connecting portion having a rounded underside contacting the electrical cable and having a substantially flat top surface. Such a staple may be constructed from several engineering plastics and a particular preferred embodiment utilizes a mineral reinforced nylon. In one particular embodiment, a 30% mineral filled 6/6 nylon is utilized. These plastic staples may be readily formed and further may be formed with a plurality of staples connected together with small attachment webs. This multiple piece arrangement would allow easy insertion of a plurality of staples into the stapling tool.

Figure 1:
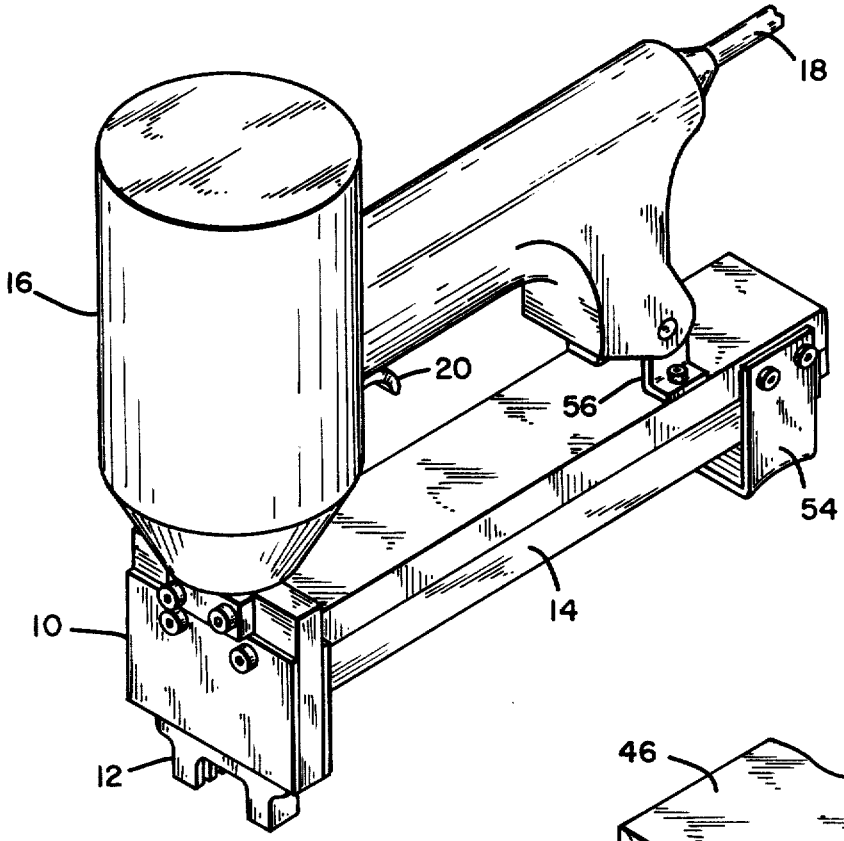
FIG. 1 is an overall perspective of one embodiment of the tool of the present invention.

FIG. 1 shows a perspective view of one embodiment of the stapling tool. A stapler head 10 with the associated compressible foot 12 is shown in perspective view. Connected to the stapler head 10 is a feed tray 14 suitable for supplying a plurality of staples to the stapler head 10. A solenoid driver 16 is also attached to the stapler head 10 for supplying power to the stapler head 10 to enable the driving of a staple contained therein. The solenoid driver 16 obtains its power from a power cord 18 adapted to be connected to a suitable electric power source and the tool is activated by the switch 20. A standoff 54 is provided to enable the tool to be rested on a flat surface and a hanger plate 56 is provided to hang the feed tray 14 to the handle of the tool completing the structure.

Figure 2:
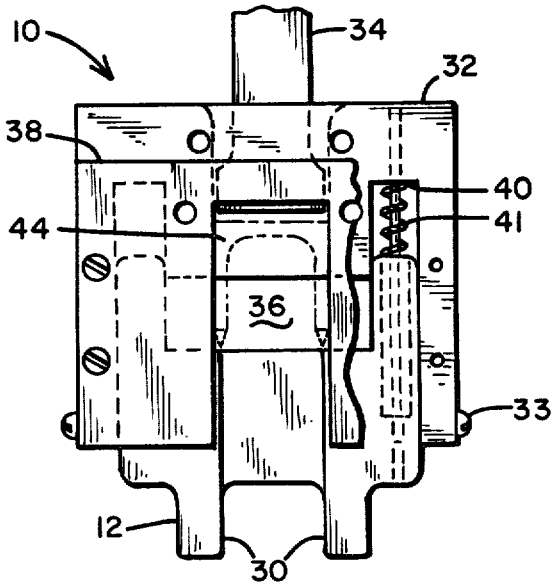
FIG. 2 is a composite front view of the stapler head of the tool of the present invention with the compressible foot uncompressed.

FIG. 2 shows a front view of the composite stapler head 10. In FIG. 2 a compressible foot 12 is shown with two feet 30 adapted to contact the workpiece and to hold the article between the two feet 30. The compressible foot 12 is received into a fixed guide 32 which provides a holding position for the staples 48. A plunger 34 is shown entering the fixed guide 32 from above ready to contact the staple to be driven. The fixed guide 32 and the compressible foot 12 is sandwiched between a front plate 36 and a rear plate 38. This view of the stapler head from the rear shows most of the rear plate 38 removed and shows the front plate 36 covering the front of the opening in the fixed guide 32.

Figure 3:
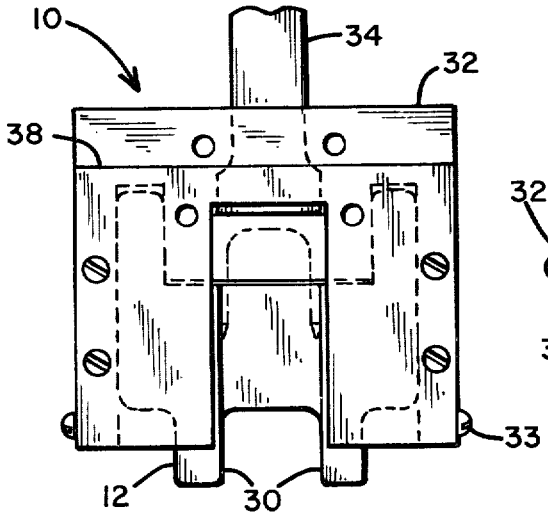
FIG. 3 is a composite front view of the same stapler head with the compressible foot compressed to the driving position.

FIG. 3 shows the same stapler head 10 with the compressible foot 12 compressed up into the fixed guide 232. Here the feet 30 of the compressible foot 12 have contacted the workpiece and are straddling the article to be fastened. The compressible foot 12 has been compressed into the fixed guide 32 engaging the staples and being ready to permit the plunger 34 to drive the staple to be driven through the compressible foot 12 and into the workpiece. The compressible foot 12 may be compressed up into the fixed guide 32 until the upper surface of the article to be fastened contacts the front plate 36.

Figure 4:
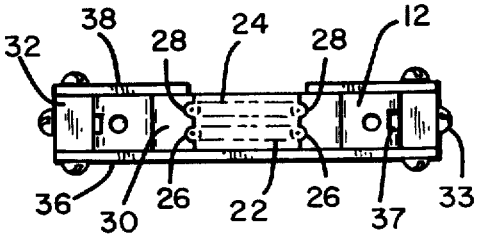
FIG. 4 is a composite bottom view of the same stapler head.

The bottom view of FIG. 4 better illustrates the cooperation of the compressible foot 12 with the fixed guide 32. This view is looking at the bottom of the feet 30 of the compressible foot 12. A staple 22 is shown in the drive position and a staple 24 is shown next to the drive position, or a retaining position. A drive groove 26 is illustrated formed in the compressible foot 12 and a retaining groove 28 is similarly shown. As the compressible foot 12 is compressed into the fixed guide 32, drive groove 26 engages the staple 22 located in the drive position. As the plunger 34 (from FIG. 3) is activated, staple 22 is driven through the drive groove 26 and into the workpiece. Note that drive groove 26 provides support for the staple 22 throughout the driving operation.

Retaining groove 28 engages staple 24 located next to the drive position. When the compressible foot 12 is compressed, retaining groove 28 engages staple 24. As long as the compressible foot remains compressed drive groove 28 remains engaged with staple 24 and prevents its advancement from the retaining position to the driving position. This feature allows the plunger 34 (again from FIG. 3) to engage staple 22 with multiple impacts without the next staple (namely staple 24) from being advanced to the drive position.

The front plate 36 and the rear plate 38 are also shown in FIG. 4. Note that the front plate 36 provides a complete cover to the front of the stapler head 10 while the rear plate 8 contain an opening allowing the insertion of additional staplers into the fixed guide 32.

While the retaining groove 28 in this embodiment provides the retention of the staple 24 located next to the drive staple 22, it is contemplated that other mechanisms for retention could perform this function. It is not necessary to be within the scope of the present invention that the retainer actually be in the form of the retaining groove 28. Other mechanisms activated by the compression of the compressible foot 12 into the fixed guide 32 could be activated to provide a physical block in front of the staple 24 to prevent its advancement from the retaining position to the drive position as long as the compressible foot 12 remains compressed.

Figure 5:
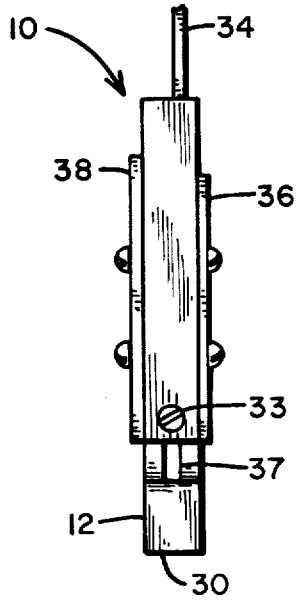
FIG. 5 is a composite side view of the same stapler head again with the compressible foot uncompressed.

FIG. 5 shows a side view of the stapler head 10 showing the fixed guide 32 with the compressible foot 12 extending from the bottom. The plunger 34 enters the fixed guide 32 from above and the front plate 36 and rear plate 38 provide front and rear covers.

Figure 6:
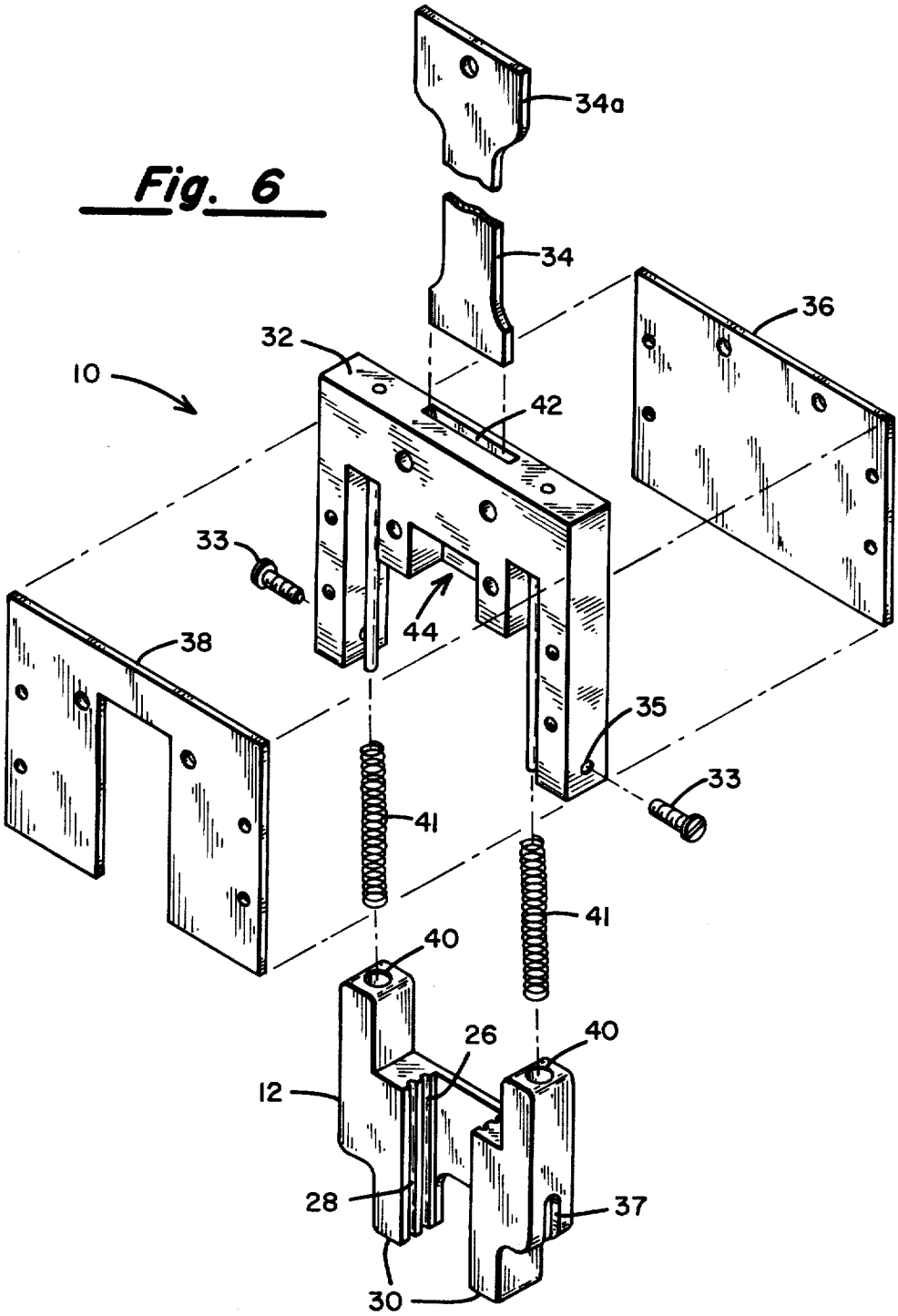
FIG. 6 is an explosion view of the stapler head.

FIG. 6 provides an exploded view of the stapler head 10. The compressible foot 12 is shown containing the drive groove 26 and retaining groove 28 and with the feet 30 for straddling the article to be fastened. The compressible foot in this embodiment also contains spring recesses 40 adapted to receive guide rods from the fixed guide 32 and springs 41 to provide the force to be overcome in compressing the compressible foot 12 into the fixed guide 32. To prevent the compressible foot 12 from falling out of the fixed guide 32, a slot 37 is provided in the compressible foot 12. A screw hole 35 is provided in the lower outside portions of the fixed guide 32 to allow for the insertion of a screw 33 into the screw hole 35 such that when the screw 33 is engaged, it engages the slot 37 which limits the lower extension of the compressible foot 12 from the fixed guide 32. An opening in the center of the fixed guide 32 provides a staple passage area 44 to allow for the holding of a staple in a drive position and the staple next to it being held in the retaining position. The staples thus held allow the drive groove 26 to engage a staple in the driving position and the retaining groove 28 to engage a staple located in the retaining position.

The plunger 34 is shown adapted to enter the top of fixed guide 32 through the plunger guide 42. The plunger 34 is thus positioned to contact the top of the staple being held in the drive position and to drive that staple through the drive grooves 26 into the workpiece. The plunger 34 contains an enlarged portion 34*a* which will prevent the plunger 34 from traveling further through the plunger guide 42 into the fixed guide 32. The enlarged portion 34*a* thus effectively limits the depth of drive obtainable. The length of the plunger 34 from the bottom to the enlarged portion 34*a* coupled with the known dimensions of the fixed guide 32 and the plunger guide 42 provide a predetermined position with respect to the bottom of the plunger 34 and the fixed guide 32 to which the staple in the drive position may be driven. With this mechanism in place, the operator of the tool need not be concerned with overdriving the staple. In a preferred embodiment, it desired that the dimension of the plunger 34 from the bottom of the plunger to the enlarged portion 34*a* be approximately equal to the distance from the plunger guide 42 to the bottom of the fixed guide 32 adjusting for the thickness of the top of the staple. In this manner, the depth of drive is limited to the approximate bottom of the fi ed guide 32. Thus, the tool may be placed over the article to be fastened and the compressible foot 12 compressed into the fixed guide 32 until the bottom of the fixed guide 32 is located at the top of the article to be fastened.

The front plate 36 and the rear plate 38 may be fastened to the fixed guide 32 with suitable fasteners such as machine screws.

Figure 7:
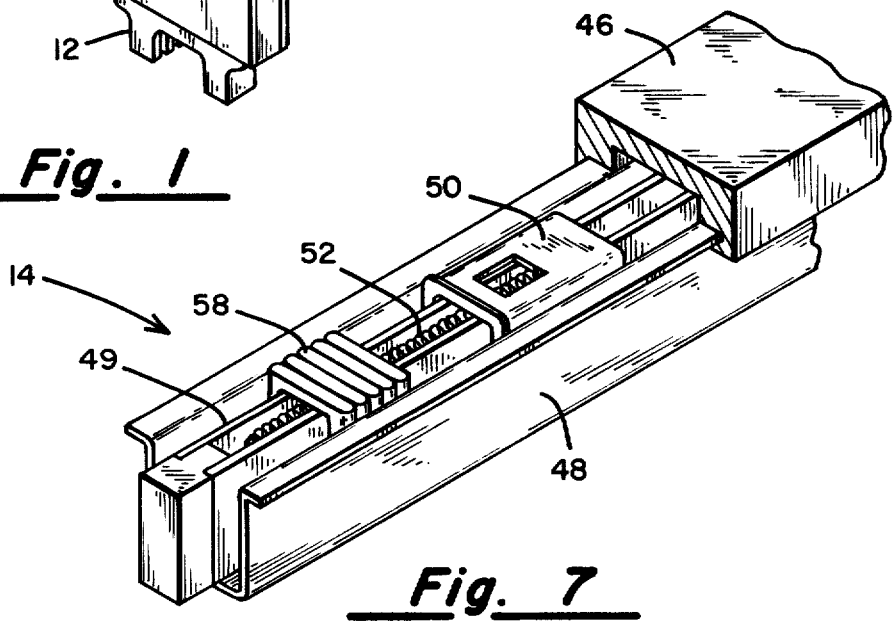
FIG. 7 is an explosion view of the feed tray assembly.

FIG. 7 shows a perspective view of the feed tray 14, which may be affixed directly to the fixed guide 32 (from FIG. 6). The feed tray body 46 contains a slot adapted to receive the feed tray 48. The feed tray 48 contains a track 49 around which the staples 58 may be inserted. A staple pusher 50 is shown activated by pusher spring 52 to provide a suitable force against the staples 58 to advance the staples to the retaining and drive positions.

The motive power furnished the plunger 34 may be furnished from a wide variety of sources. For example, the power furnished the plunger can come from conventional hand power; for example, in the operation of a hammer-like device by which the power supply to the plunger may be the impact force of the hammer-like device. Further, power may be supplied to the plunger from a compressed air source or from air contained in a $CO_2$ cartridge. Still further, the power may be supplied as shown in FIG. 1 from an electric powered solenoid. Such an electric solenoid to be utilized in the situation may be similar to the solenoid utilized in the Model E Electric Tacker manufactured by Duo-Fast Corporation, Franklin Park, Ill.

Figure 8:
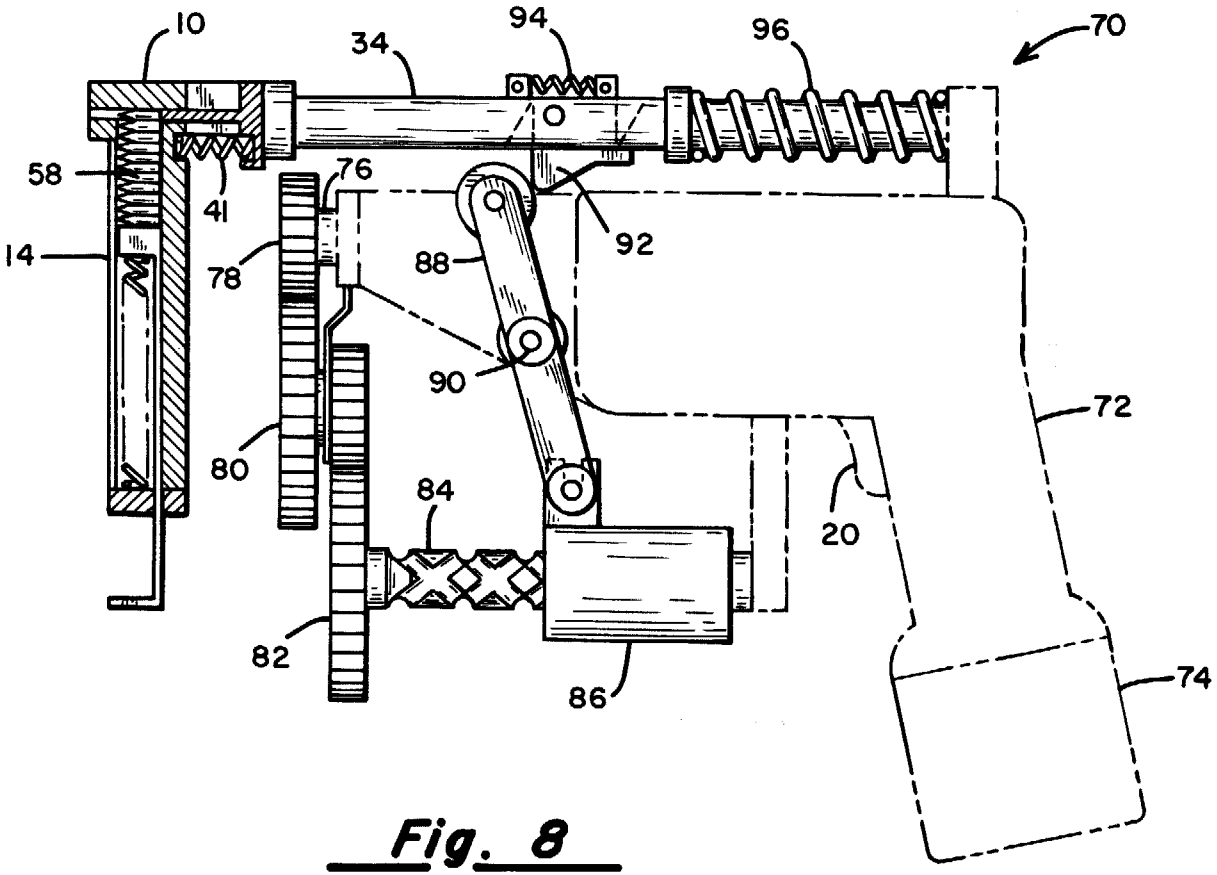
FIG. 8 is an overall perspective view of an embodiment of the tool of the present invention utilizing a spring for the driving force.

Another embodiment of a mechanism to power the plunger 34 is shown in FIG. 8. In FIG. 8 a ram spring 96 drives the plunger 34. Overall, the rotary drill drive mechanism 70 is shown powered by a cordless electric motor 72. The power is supplied to the cordless electric motor 72 by an energy pack 74. The motor shaft 76 from the cordless electric motor 72 is shown driving gears 78, 80 and 82. This gear train from gears 78, 80 and 82 is shown driving a ball screw reverser 84. A carrier 86 on the ball screw reverser 84 operates when thr drill is operated and moves a trip lever 88 around pivot 90. A cam follower 92 activates a ram trip spring 94 which allows the ram spring 96 to impact the plunger 34.

To operate the stapling tool of the present invention, it is necessary only to position the tool over the cable or article to be fastened. The tool is pushed against the workpiece compressing the compressible foot until the front plate 36 contacts the top of the article to be fastened. The tool is then activated and the plunger 34 drives the driver staple 22 through the drive groove 26 through the compressible foot and into the workpiece. While the compressible foot 12 is compressed into the fixed guide 32, the retaining groove 28 holds the staple 24 being held in the retaining position from advancing to the drive position. Thus, if multiple impacts are required for the tool's operation in order to properly drive the staple into the workpiece, it is important that the comressible foot remain compressed until the staple 22 is completely driven. When the compressible foot 12 is allowed to retract from the fixed guide 32, the staple 22 being retained in the retaining position is advanced to the next position and the next operation of the tool may be initiated.

Thus, it can be seen that there has been shown and decribed a novel stapler tool. It is to be understood, however, that various changes, modifications and substitutions in the form of the details to the described tool can be made by those skilled in the art without departing from the scope of the invention as defined in the following claims.

What is claimed is:

1. A tool for applying fasteners to fasten an article to a workpiece, comprising:

a fixed guide for holding a plurality of said fasteners therein, one of said plurality of fasteners being held in a drive position;

a compressible foot operatively coupled to said fixed guide defining a drive groove, said compressible foot adapted to contact said workpiece and be compressed into said fixed guide, said drive groove engaging the fastener located in said drive position and providing support for said fastener during a driving operation;

said compressible foot and said fixed guide cooperating with each other and with said article and said workpiece to allow said compressible foot to be compressed into said fixed guide a distance dependent upon the thickness of said article;

a plunger operatively coupled to said fixed guide for driving the fastener located in said driving position from said fixed guide through said drive groove of said compressible foot and into said workpiece; and a drive limiting means coupled to said plunger for preventing said plunger from driving beyond a fixed predetermined position relative to said fixed guide;

whereby said fastener located in said drive position may be driven into said workpiece a distance relative to said fixed guide and into said workpiece a distance dependent upon said thickness of said article.

2. A tool as in claim 1 wherein said drive limiting means comprises an enlarged portion of said plunger and a cooperating portion of said fixed guide to prevent said plunger from driving beyond said fixed predetermined position.

3. A tool as in claim 2 which further comprises a driving means coupled to said plunger for providing striking power to said plunger.

4. A tool as in claim 3 wherein said driving means is an electric powered solenoid.

5. A tool as in claim 3 wherein said driving means is a spring.

6. A tool as in claim 5 wherein said spring is cocked by action of a rotary electric motor.

7. A tool as in claim 2 wherein the portion of said compressible foot which is adapted to contact said workpiece contains a means for positioning said article on said workpiece during the fastening operation.

8. A tool as in claim 7 which further comprises a fastener holding means coupled to said fixed guide for storing fasteners and supplying additional fasteners to said fixed guide.

9. A tool for applying fasteners to fasten an article to a workpiece, comprising:

a fixed guide for holding a plurality of said fasteners therein, one of said plurality of fasteners being held in a drive position and the fastener next to said one of said plurality of fasteners being held in a retaining position;

a compressible foot operatively coupled to said fixed guide defining a drive groove, said compressible foot adapted to contact said workpiece and be compressed into said fixed guide, said drive groove engaging the fastener located in said drive position and providing support for said fastener during the driving operation;

said compressible foot and said fixed guide cooperating with each other and with said article and said workpiece to allow said compressible foot to be compressed into said fixed guide a distance dependent upon the thickness of said article;

a retaining means coupled to said fixed guide and activated by the compression of said compressible foot for preventing advancement of the fastener being held in said retaining position to said drive position;

a plunger operatively coupled to said fixed guide for driving the fastener located in said driving position from said fixed guide through said drive groove of sad compressible foot and into said workpiece; and a drive limiting means coupled to said plunger for preventing said plunger from driving beyond a fixed predetermined position relaitve to said fixed guide;

whereby said fastener located in said drive position may be driven with a plurality of driving strokes into said workpiece a distance relative to said fixed guide and into said workpiece a distance dependent upon said thickness of said article.

10. A tool as in claim 8 wherein said retaining means is a retaining groove defined in said compressible foot and wherein said retaining groove engages the fastener located in said retaining position for preventing advancement of the fastener being held in said retaining position to said drive position as long as said compressible foot remains compressed.

11. A tool as in claim 9 which further comprises a driving means coupled to said plunger for providing striking power to said plunger.

12. A tool as in claim 11 wherein said driving means is an electric powered solenoid.

13. A tool as in claim 11 wherein said driving means is a spring.

14. A tool as in claim 13 wherein said spring is adapted to be cocked by action of a rotary electric motor.

15. A tool as in claim 10 wherein the portion of said compressible foot which is adapted to contact said workpiece contains a means for positioning said article on said workpiece during the fastening operation.

16. A tool as in claim 15 which further comprises a fastener holding means coupled to said fixed guide for storing fasteners and supplying additional fasteners to said fixed guide.

17. A tool for applying fasteners to fasten an article to a workpiece, comprising:

a fixed guide for holding a plurality of said fasteners therein, one of said plurality of fasteners being held in a drive position;

a compressible foot operatively coupled to said fixed guide defining a drive groove, said compressible foot adapted to contact said workpiece and be compressed into said fixed guide, said drive groove engaging the fastener located in said drive position and providing support for said fastener during a driving operation until said fastener enters said workpiece;

a plunger operatively coupled to said fixed guide for driving the fastener located in said driving position from said fixed guide through said drive groove of said compressible foot and into said workpiece;

positioning means coupled to said compressible foot, said positioning means for cooperating with said article to ensure the proper positioning of said fastener with respect to said article;

said compressible foot and said fixed guide cooperating with each other and with said article and said workpiece to allow said compressible foot to be compressed into said fixed guide a distance dependent upon the thickness of said article; and a drive limiting means coupled to said plunger for preventing said plunger from driving beyond a fixed predetermined position relative to said fixed guide;

whereby said fastener located in said drive position may be fully supported by said drive groove while being driven into said workpiece.

18. A tool as in claim 17 which further comprises a retaining means coupled to said fixed guide and activated by the compression of said compressible foot for preventing advancement of the fastener being held in a retaining position next to the fastener being held in said drive position from said retaining position to said drive position.

19. A tool as in claim 18 wherein said retaining means is a retaining groove defined in said compressible foot and wherein said retaining groove engages the fastener located in said retaining position for preventing advancement of the fastener being held in said retaining position to said drive position as long as said compressible foot remains compressed.

* * * * *